US012662916B1

(12) United States Patent
Pyron et al.

(10) Patent No.: US 12,662,916 B1
(45) Date of Patent: Jun. 23, 2026

(54) BELLOWS SYSTEM FOR ELECTRICAL SUBMERSIBLE PUMP

(71) Applicant: Halliburton Energy Services, Inc., Houston, TX (US)

(72) Inventors: Steven Pyron, Tulsa, OK (US); Matthew Thomas King, Denver, CO (US); Bryan Coates, Leduc (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/184,572

(22) Filed: Apr. 21, 2025

(51) Int. Cl.
*E21B 43/12* (2006.01)
*F04D 13/06* (2006.01)
*F04D 13/10* (2006.01)

(52) U.S. Cl.
CPC ..... *E21B 43/128* (2013.01); *F04D 13/062* (2013.01); *F04D 13/10* (2013.01)

(58) Field of Classification Search
CPC ..... E21B 43/128; F04D 13/10; F04D 13/062; H02K 5/132
See application file for complete search history.

(56) References Cited

U.S. PATENT DOCUMENTS 2,404,783 A * 7/1946 Blom ..... H02K 5/132 277/366
4,436,488 A * 3/1984 Witten ..... F04B 47/06 310/87
7,326,034 B2 * 2/2008 Sheth ..... E21B 43/128 415/199.2
7,806,670 B2 * 10/2010 Du ..... F04D 13/10 310/87
8,328,539 B2 * 12/2012 Watson ..... E21B 43/128 166/105.3
8,430,649 B2 * 4/2013 Albers ..... F04D 13/10 310/87
8,651,837 B2 * 2/2014 Tetzlaff ..... F04D 13/0653 310/87
9,528,368 B2 * 12/2016 Semple ..... G01L 9/0039
9,995,118 B2 6/2018 Tanner et al.
11,795,795 B2 * 10/2023 Reeves ..... F04D 13/062
11,976,660 B2 * 5/2024 Hollohan ..... F15B 7/10
(Continued)

FOREIGN PATENT DOCUMENTS

WO WO-2011062797 A2 * 5/2011 ..... F04D 13/062
WO WO-2016032521 A1 * 3/2016 ..... F04D 13/10

OTHER PUBLICATIONS

Foreign Communication from Related Application—International Search Report and Written Opinioof the International Searching Authority, International Application No. PCT/US2025/027859, dated Jan. 7, 2026, 12 pages.

*Primary Examiner* — Nathan C Zollinger
(74) *Attorney, Agent, or Firm* — Conley Rose, P.C.; Rodney B. Carroll

(57) ABSTRACT

A bellows system for an electrical submersible pump includes a housing, a bellows disposed within the housing, a stop having a through hole, and a chamber disposed on an opposite side of the stop from the housing. The bellows may include a first end secured to the housing and a second end configured to move within the housing. At a maximum extension of the bellows, the second end abuts the stop. The chamber is in fluid communication with an exterior of the housing via first openings.

20 Claims, 19 Drawing Sheets

(56) References Cited

U.S. PATENT DOCUMENTS

| | | | | |
|---|---|---|---|---|
| 2002/0192090 | A1* | 12/2002 | Du | F04D 13/062<br>417/423.11 |
| 2007/0074872 | A1 | 4/2007 | Du et al. | |
| 2011/0014071 | A1 | 1/2011 | Du et al. | |
| 2011/0274565 | A1 | 11/2011 | Tetzlaff | |
| 2015/0132158 | A1* | 5/2015 | Reeves | F04B 35/04<br>417/410.1 |
| 2015/0354327 | A1 | 12/2015 | Semple et al. | |
| 2020/0072225 | A1 | 3/2020 | Parmeter et al. | |

* cited by examiner

BELLOWS SYSTEM FOR ELECTRICAL SUBMERSIBLE PUMP

BACKGROUND

Below-the-motor (BMB) metal bellows may be used in electrical submersible pump (ESP) high temperature applications such as steam assisted gravity drainage (SAGD). The BMB has some form of open communication with the wellbore in order equalize the pressure differential between the inside and outside of the metal bellows. This communication is conventionally accomplished using holes in the housing around the bellows or in the barstock pieces below/above the bellows. This may present a problem in that sand, wellbore fluids, or other solids can clog these holes and prevent pressure equalization within the system. Also, sand or wellbore solids that get into the metal bellows chamber can prevent the bellows from movement, impairing their function. The system and method of the present disclosure may address one or more of these issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 16 is a perspective view of the cap with a spiral ridge, according to an embodiment;

DETAILED DESCRIPTION

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

Figure 1:
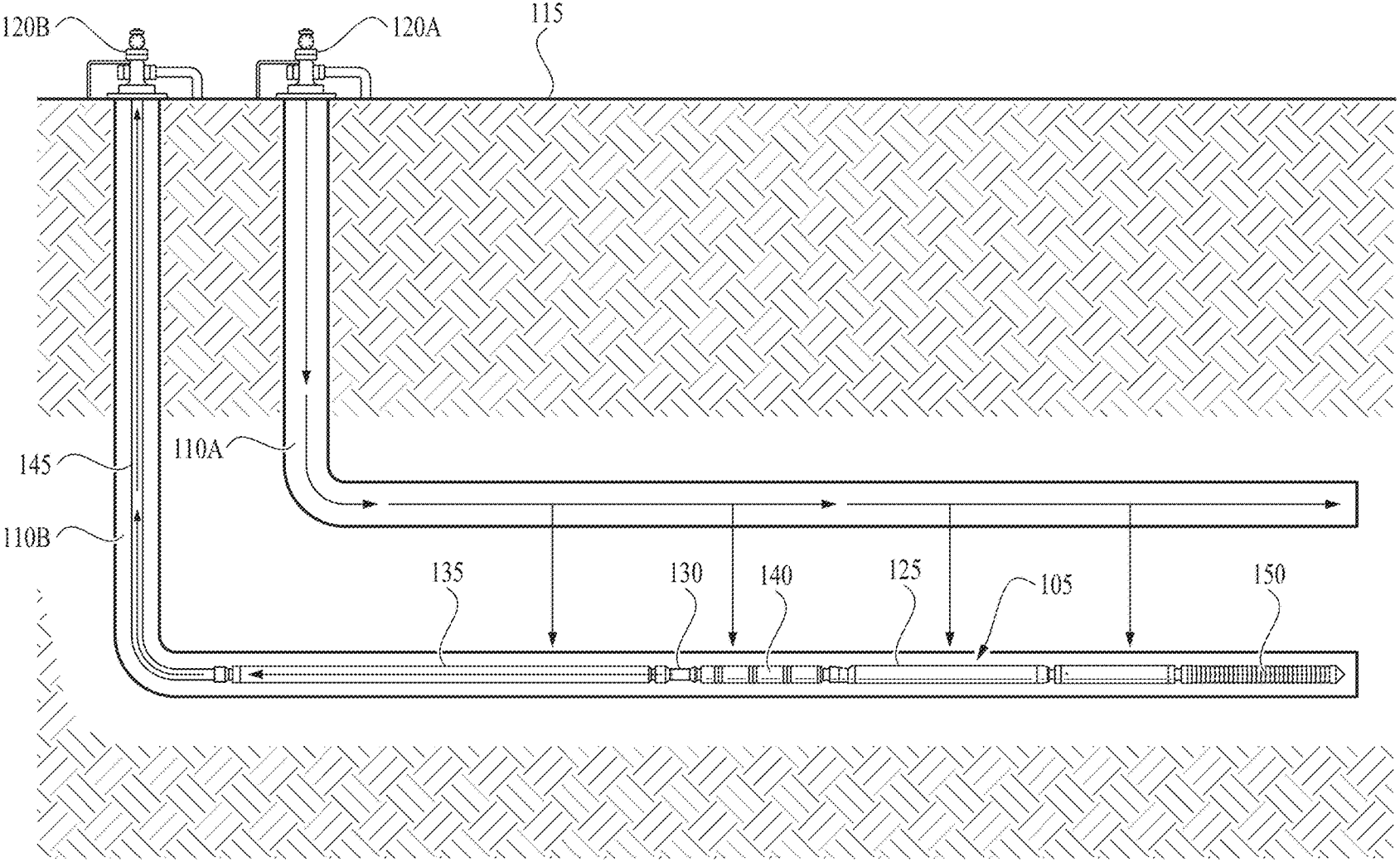
FIG. 1 is a side view of an electrical submersible pump (ESP) assembly, according to an embodiment of the present disclosure.
Figure 2:
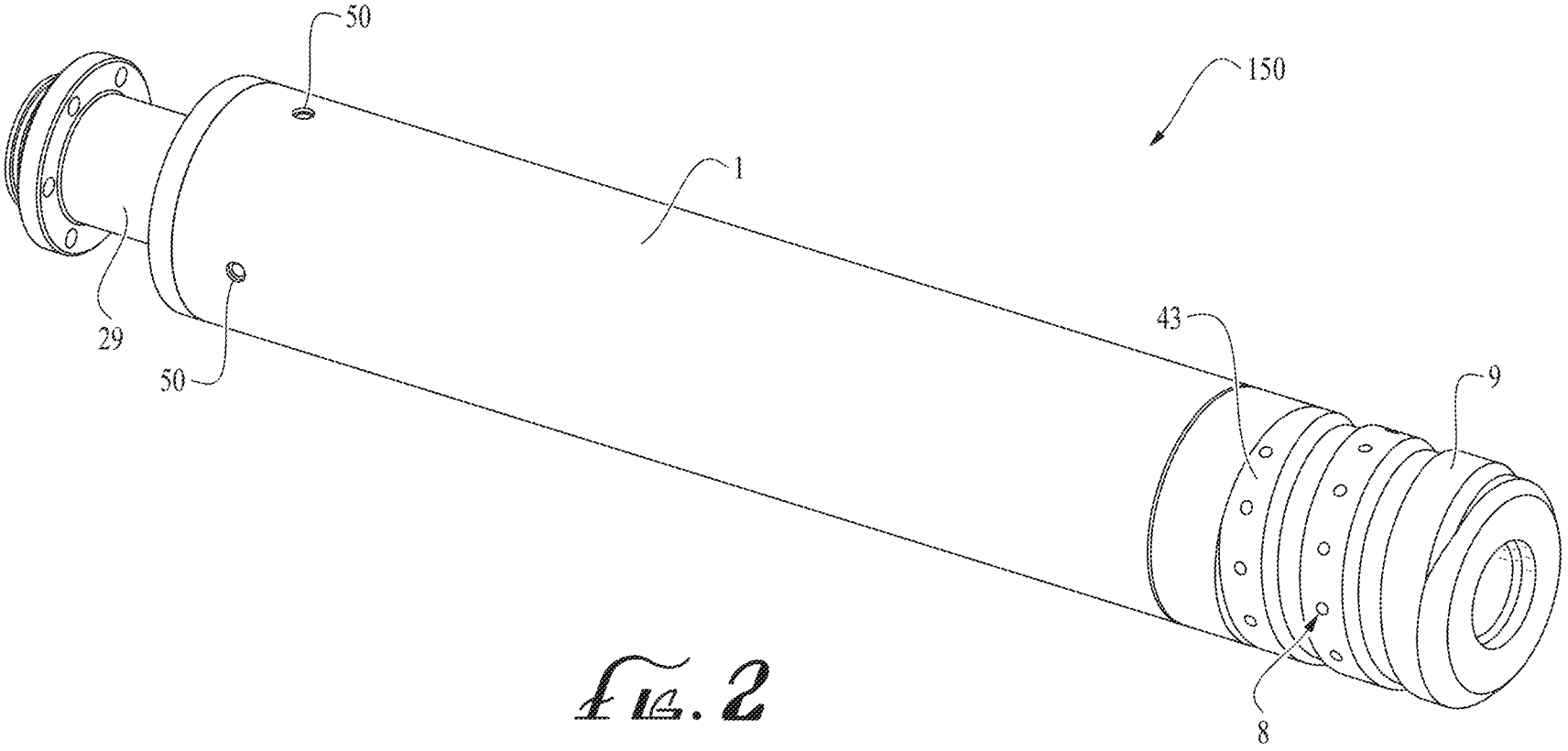
FIG. 2 is a perspective view of a bellows system for an electrical submersible pump, according to an embodiment.

FIG. 1 illustrates an exemplary ESP assembly of an illustrative embodiment. ESP assembly 105 may be downhole in a well, such as a well containing, oil, heavy oil, bitumen, natural gas and/or water. ESP assembly 105 may be arranged vertically or horizontally in the well and/or may extend through a curved portion of the well. For example, FIG. 1 illustrates an exemplary embodiment where ESP assembly 105 is arranged horizontally in lower well 110B of two horizontal wells 110A, 110B, situated one above the other. In horizontal embodiments, the pump end 105 of ESP assembly 105 may face downstream and/or through the lower well 110B in the direction towards wellhead 120B. During deployment of ESP assembly 105 into lower well 110B, ESP assembly 105 may first be lowered vertically and then turn to a horizontal orientation as the well curves in order to operate in a horizontal orientation. In operation, high temperature steam may be injected continuously into the upper well 110A via the wellhead 120A, heating the heavy oil or bitumen, reducing its viscosity, and enabling it to flow. Due to gravity, the heated, less viscous oil may drain downward through the formation into the lower well 110B, where it may be pumped by the ESP 105 to the surface at the wellhead 120B.

As shown in FIG. 1, ESP assembly 105 may include electric motor 125 that operators to turn the shafts extending longitudinally through ESP assembly 105 downstream of ESP motor 125, such as the shaft of ESP pump 135. In some embodiments, no shaft extends through bellows system 150 below (e.g., motor expansion chamber) upstream of motor 125. Electric submersible motor 125 may be an induction motor such as a three-phase, two-pole squirrel cage induction motor. Intake 130 may serve as the intake for ESP pump 135. ESP pump 135 may be a multi-stage centrifugal pump including impeller and diffuser stages stacked one above the other around the shaft of ESP pump 135. The impellers rotate with the shaft of ESP pump 135 inside non-rotating diffusers to create pressure lift. Production tubing 145 may carry fluid lifted by ESP pump 135 to surface 115. In some embodiments, a seal section 140 is located between ESP pump 135 and motor 125. The seal section 140 may serve to keep motor oil separate from well fluid and provide pressure equalization to for motor 125.

In some embodiments, custom designed geometry may be used to prevent or delay clogs in the bellows system 150. The outside of the intake may be designed with ridges or a helical spiral configuration in order to create low pressure zones while wellbore fluid is flowing past the intake. Sand or solids in the fluid may settle in between the ridges due to the lower pressure zones created. Conversely, the fluid communication holes may be located at the top of the ridges away from the low pressure zones. Also, when oriented horizontally as is common with SAGD wells, the inside of the anti-clog intake for bellows systems may feature a large open area which then necks down to a smaller opening that communicates with the metal bellows chamber. This feature may provide a tortuous path for any sand or solids which penetrate past the outer ridges and intake holes before entering the bellows chamber. This may provide a redundant system of protection from clogging and/or sand/solid ingress into the metal bellows or bag chamber. The internal geometry of the anti-clog intake is may be specially designed as a torturous path for any sand that does ingress past the external ridges, which may create a two part redundant protection system for the below-the-motor bellows.

In some embodiments, the anti-clog intake (or cap) consists of a machined barstock piece with three external ridges, external holes for wellbore fluid communication, a large, open, internal area for sand collection, a large internal thru hole for communication with the bellows chamber, one end threaded to attach to a housing, the other end threaded with EUE pipe thread, and milled slots on the top to allow for fluid passage. An internal tube may be provided with grooves or holes cut in a pattern to promote sand mitigation. In some embodiments, the cap is made from carbon or stainless steel. The three external ridges feature may be flat (90 degree) on one side of the ridge and an angled (45 degree) on the opposing side. The valley created on the outer diameter of the part may allow for a low pressure zone to help coax sand or solids away from the external communication holes. External holes may be drilled into the top of the ridges for fluid communication. Each ridge may have four holes, spaced 90 degrees apart. The hole diameter may be set so that the minimum total area for external communication is at least equal to the same area as the large internal communication thru hole.

A large internal cavern may be machined inside the piece to allow for sand/solids collection should it penetrate the external communication holes. A singular large thru hole may be drilled into the top of the piece to allow fluid communication from the internal cavern into the bellows chamber. The top end of the piece may be threaded to match the bellows housing for attachment. The bottom end of the piece is may be threaded with EUE pipe thread to allow for attachment of additional equipment to the bottom of the unit. The top of the piece may serve as a mechanical stop for the metal bellows when fully expanded. To prevent the bottom of a fully expanded metal bellows from sealing the thru hole in the top of the cap, milled slots may be added as fluid communication pathways during this condition.

Alternate embodiments of the invention may include different shapes, not limited to a cylindrical piece, different materials including metals (aluminum, bronze, Inconel, Hastelloy, etc.), plastics, etc. The number and shape of the external ridges may vary along with the angles used to achieve the external ridges. The ridges may be offset, spaced differing amounts, have grooves on one side or the other, or any number of geometrical changes to help create a low pressure zone, coax sand/solids out of solution, or encourage sand/solids to stay in solution. The external holes may vary in diameter, number, be angled, or positioned anywhere on the piece. Slots or grooves may be used instead. The holes may be machined in such a way as to add a filtering element to the holes or a filtering screen could be wrapped around the whole outer or inner diameter of the piece. An internal tube may be used as a filtering medium.

The internal open space may vary in shape or size or be eliminated altogether. Device(s) may be inserted into the internal space to act as filtering mechanisms or create a more torturous path for the fluid and/or sand/solids. The large internal thru hole may vary in size or be multiple holes, straight or angled. The top end may be threaded with various sizes of threads, be made into a flanged connection for bolts, or any number of connection methods. The bottom end may be threaded with EUE pipe thread, may be made into a flanged connection, or may be completely closed off. The end of the piece may serve as a stop for the metal bellows. Fluid passageways may be implemented in a variety of ways including milled slots varying in size/depth, holes, or varying the shape of the piece itself to allow fluid to pass by. One or more devices may be mechanically added to provide a stop which also may or may not contain fluid passageways. Also, the device may not be a separate piece, but may be integrated into other parts of the below-the-motor bellows assembly such as the bellows housing, head, base, or an additional attachment to the assembly. The anti-clog intake may be made to be modular so as to be able to add several together in a series or parallel configuration.

Referring to FIGS. 2-5, a bellows system 150 for an electrical submersible pump may include a housing 1 and a tubular bellows 2 disposed within the housing 1. The bellows 2 may include an expansion chamber that is configured to expand and contract depending on the volume of fluid (e.g., oil) inside it. The bellows 2 may include a first end 3 secured (e.g., welded) to the housing 1 (e.g., a metal tube) and a second end 4 configured to move within the housing 1. A sleeve 27 may be disposed at the second end 4 that is configured to slide along the interior surface of the housing 1. A flange 29 may be attached to the second end 4 of the housing 1. The flange 29 may include a hollow interior 30 which brings the interior of the bellows 2 and the motor into fluid communication. The flange 29 may be fastened to the housing 1 by a threaded connection (e.g., threads of the flange 29 engage threads of the housing 1). The flange 29 may be bolted to the motor at an opposite end of the flange 29 from the threads.

The bellows system 150 may further include stop 5 having a through hole 6. For example, the through hole 6 may extend axially through the stop 5 at a center of the stop 5. At a maximum extension of the bellows 2, the second end may abut the stop 5. For example, the stop 5 may be positioned such that it prevents over-extension of the bellows 2. The bellows 2 may be free to extend up until the point of contact between the bellows 2 and the stop 5. The bellows 2 may be configured to contact an axial surface 11 of the stop 5 and/or another feature that is part of the stop 5.

The bellows system 150 may further include a chamber 7 disposed on an opposite side of the stop 5 from the housing 1. The chamber 7 may be in fluid communication with an exterior of the housing 1 (e.g., a wellbore environment which surrounds the ESP) via first openings 8. In some embodiments, the housing 1 does not any openings or holes along its length (e.g., the interior of the housing 1 at least between the flange 29 and the stop 5 may not be in fluid communication with the wellbore environment). In some embodiments, the housing 1 has holes that are covered in screen material (e.g., a mesh).

Equalizing ports 50 may be formed in the housing 1 proximate to the first end 3 of the bellows 2. The equalizing ports 50 may be covered in mesh to help prevent particulates from entering the space between the bellows 2 and the interior of the housing 1.

Figure 5:
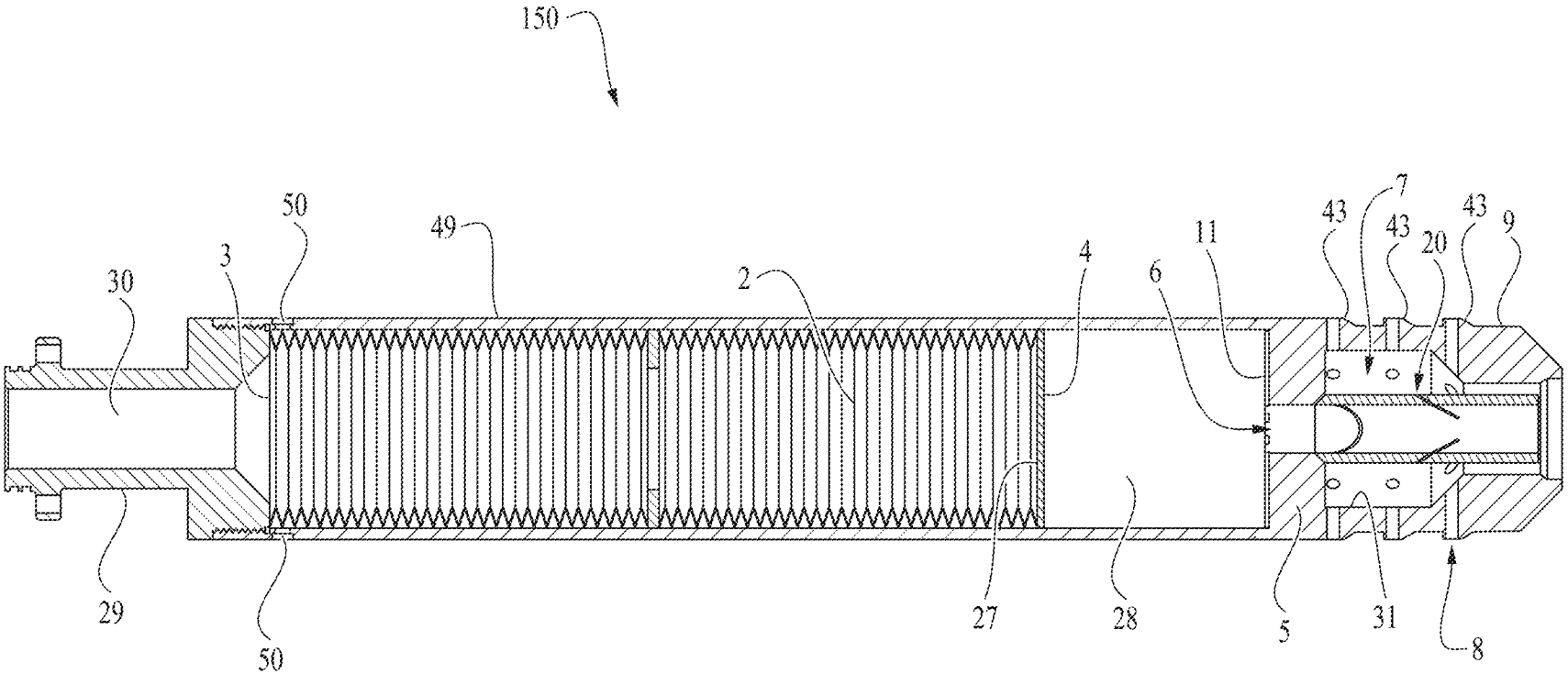
FIG. 5 is a cross sectional view of the bellows system, according to another embodiment.

Referring to FIG. 5, the chamber 7 may be defined by an integral housing 49, and the first openings 8 may be formed in the integral housing 49. That is, the integral housing 49 may extend beyond the stop 5 on an opposite side of the stop 5 from the bellows 2 the integral housing 49 may enclose (e.g., define the walls of) the chamber 7. In some embodiments, the stop 5 is integrally formed with the integral housing 49, and in other embodiments, the stop 5 is a separate component. Any structural configuration described herein with respect to the cap 9 may be applied the housing in the embodiments in which the integral housing 49 defines the chamber 7.

Figure 3:
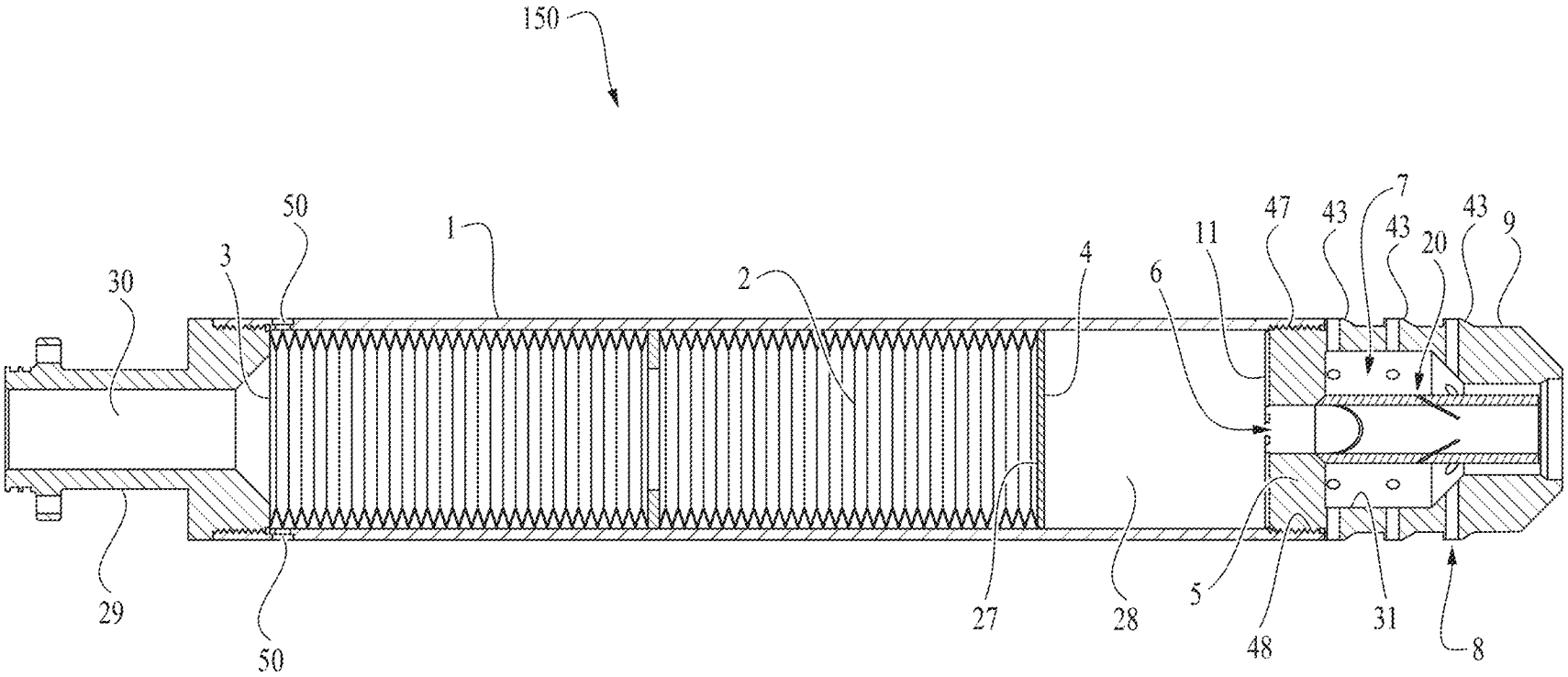
FIG. 3 is a side cross sectional view of the bellows system of FIG. 2 with the bellows in a partially retracted position.
Figure 4:
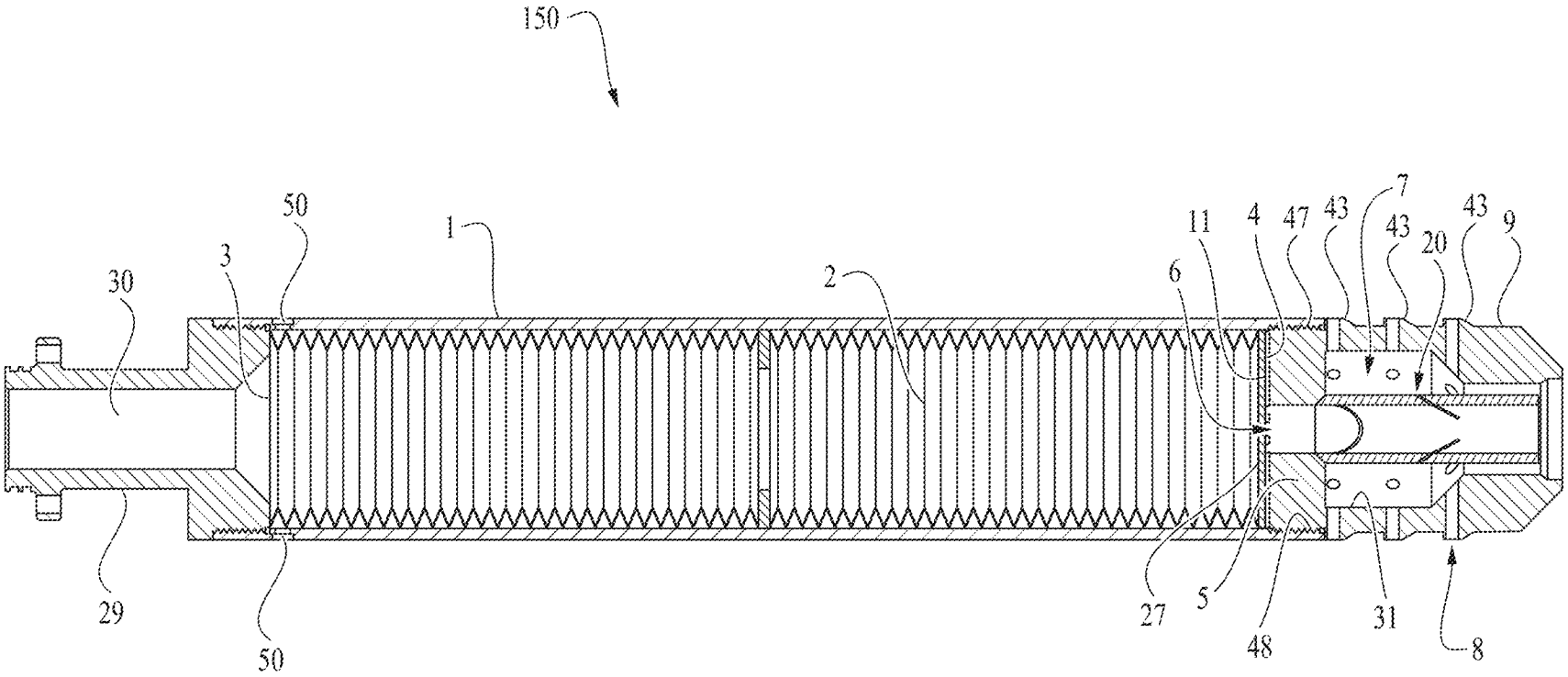
FIG. 4 is a side cross sectional view of the bellows system of FIG. 2 with the bellows in a fully extended position.

Referring to FIG. 3, the chamber 7 may be defined by a cap 9 which may include the stop 5. That is, the walls of the cap 9 may define the chamber 7. In some embodiments, the stop 5 is integrally formed with the rest of cap 9. In some embodiments, the stop 5 is a separate component fastened to (e.g., connected via threads (e.g., screwed onto)) to the rest of the cap 9. The first openings 8 may be formed in the cap 9. For example, the first openings 8 may extend from an outer circumferential surface 16 of the cap 9 to an inner circumferential surface 31 of the cap 9. The cap 9 may be secured to the housing 1 (e.g., via threads 47 on stop 5 engaging threads 48 of the housing 1). For example, the cap 9 may be screwed onto the housing 1. The chamber 7 may narrow moving away from the bellows. The cap 9 may be configured such that fluid from the wellbore environment may readily flow through the first openings 8, through the second openings 20, through the through hole 6, and into the housing 1 between the sleeve 27 and the axial surface 11 of the stop 5. The various structural features of the bellows system 150 may make it difficult for particulates to follow this flow path.

Figure 6:
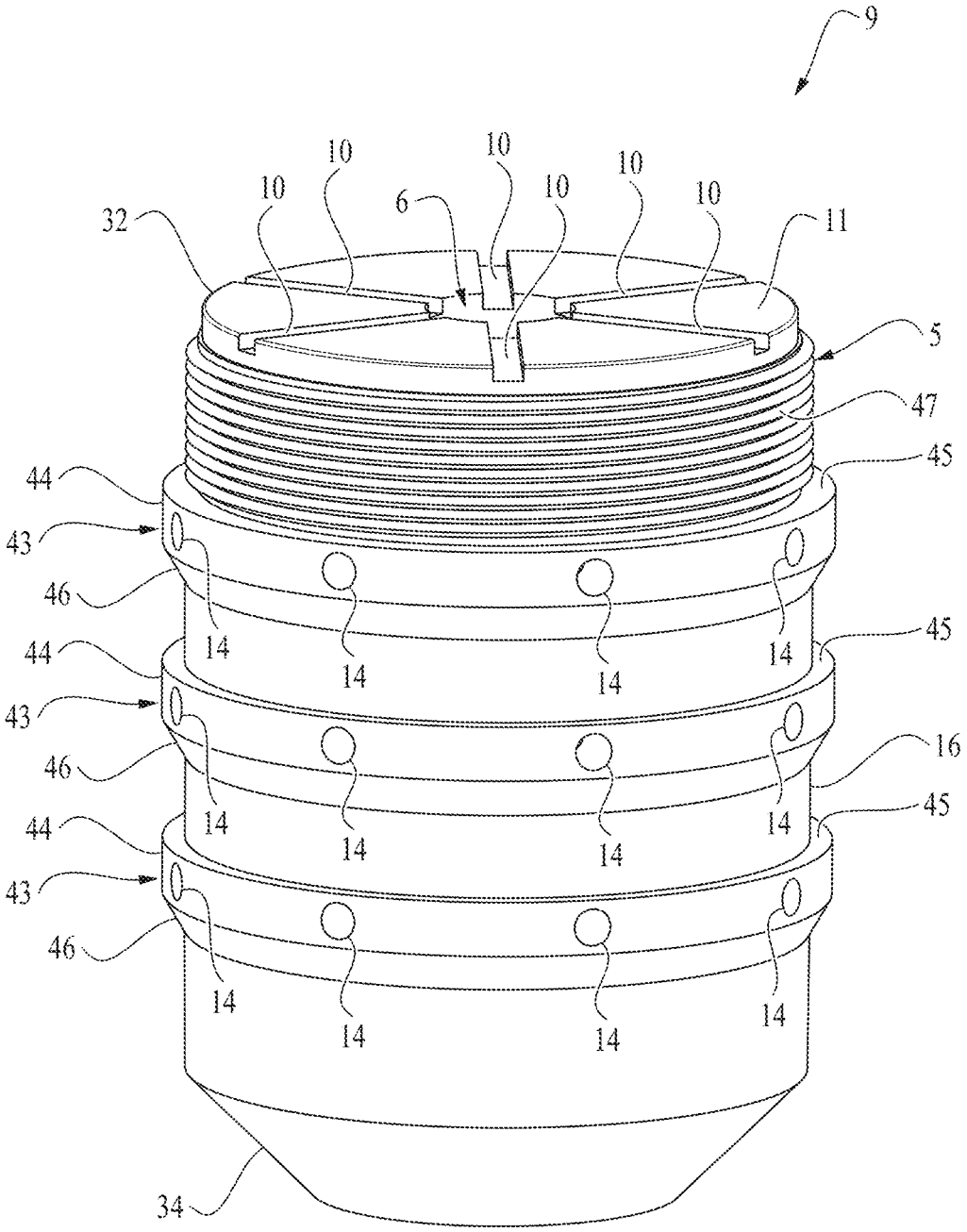
FIG. 6 is a perspective view of the cap of the bellows system, according to an embodiment.

Referring to FIG. 6, grooves 10 may be formed in an axial surface 11 of the stop 5. The second end of the bellows may be configured to abut the axial surface 11 of the stop 5. The grooves 10 may extend radially outward from the through hole 6 to the edge 32 of the stop 5. There may be one, two, three, four, five, six, seven, eight, nine, ten, eleven, twelve, or more grooves 10. The stop 5 may include a threads 47 for threaded engagement with the bellows system 150. The stop 5 may include a chamfer 34 at an end of the stop 5 opposite to the axial surface 11 for ease of insertion of the ESP into the wellbore.

Figure 7:
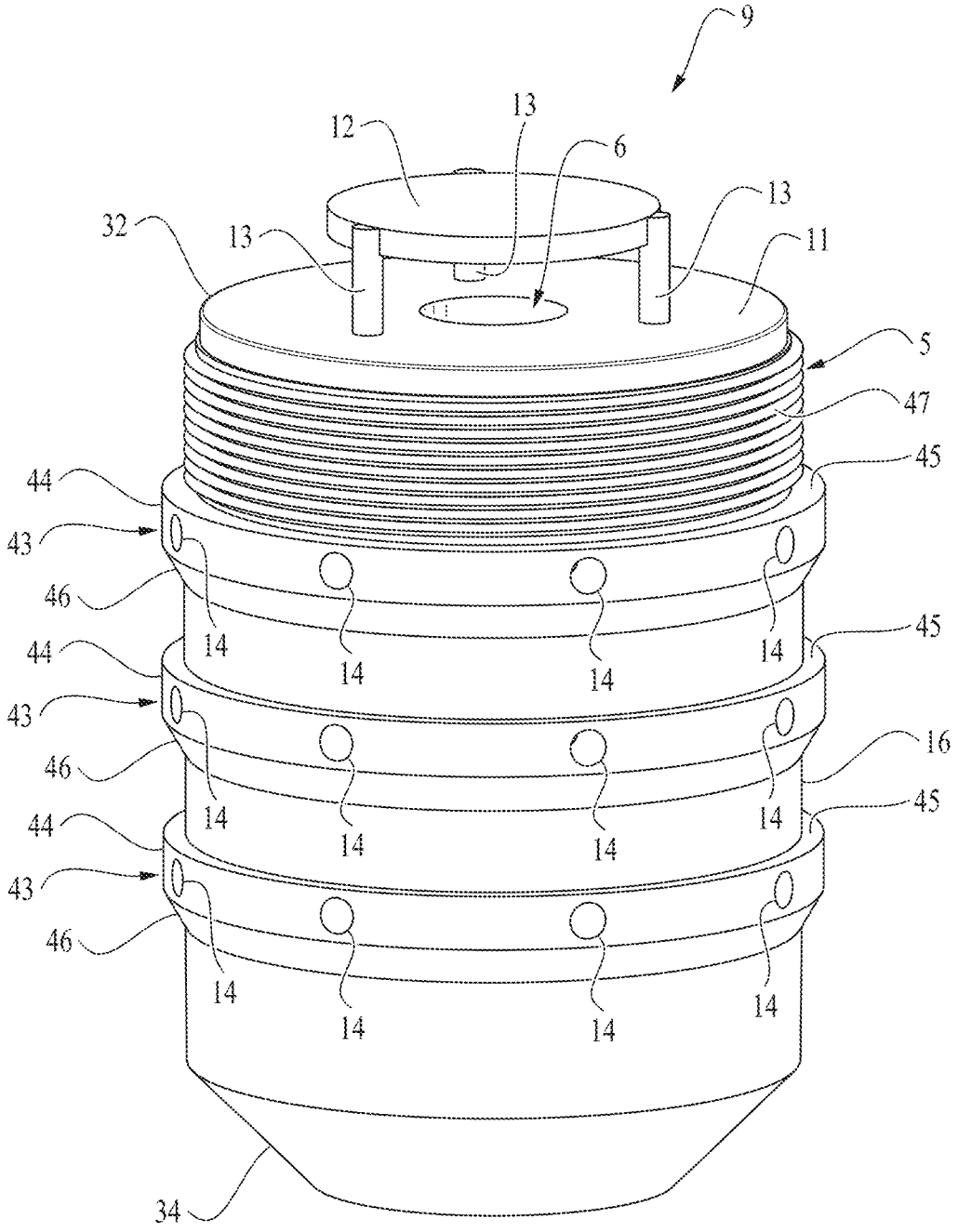
FIG. 7 is a perspective view of the cap, according to another embodiment.

Referring to FIG. 7, the stop 5 may include a platform 12 and legs 13 extending from the platform 12 to the axial surface 11 of the stop 5. The second end of the bellows may be configured to abut the platform 12. There may be any suitable number of legs 13, for example, one, two, three, four, five, six, seven, eight, nine, ten, eleven, twelve, or more legs.

Figure 8:
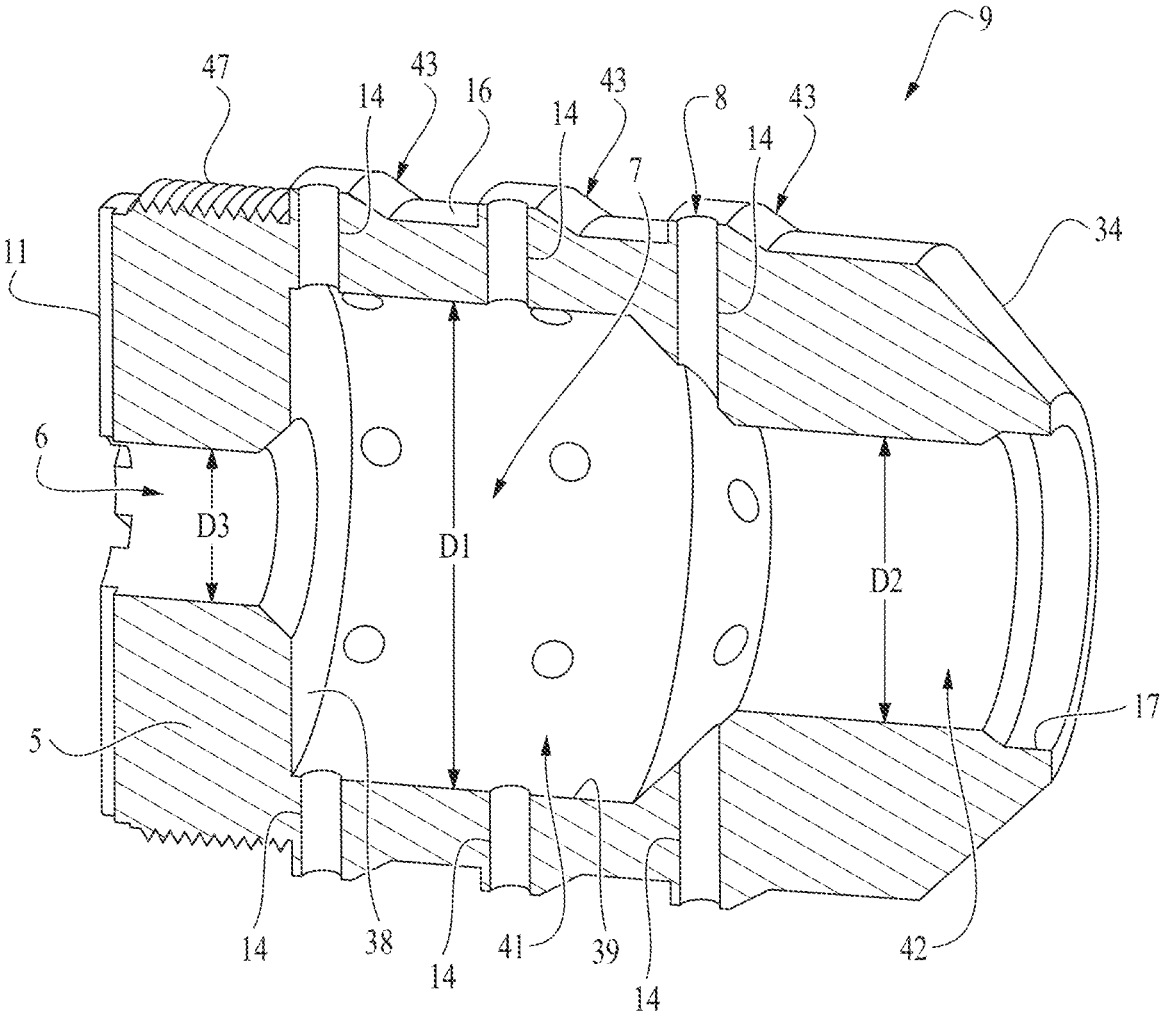
FIG. 8 is a perspective cross sectional view of the cap, according to an embodiment.
Figure 9:
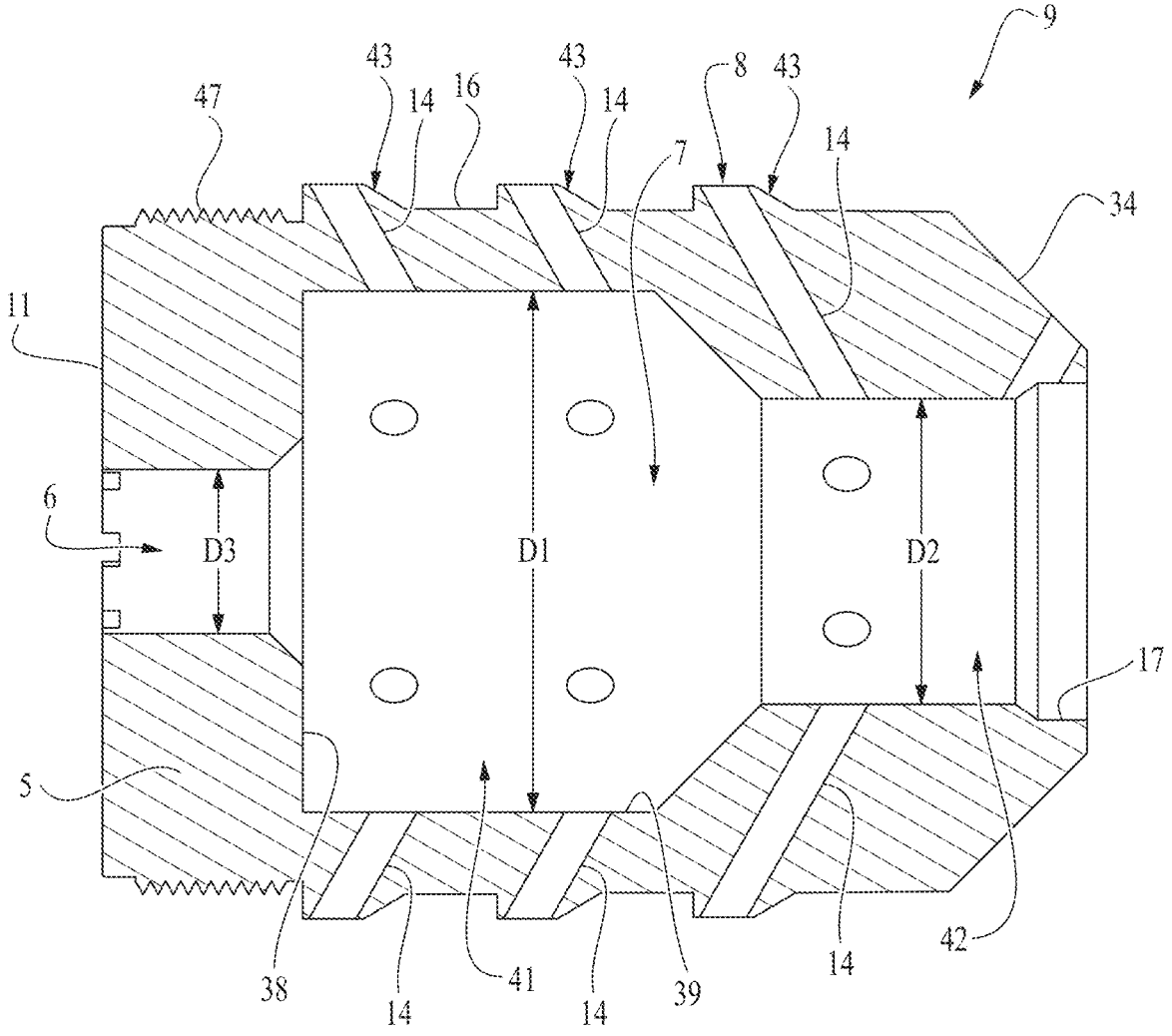
FIG. 9 is a side cross sectional view of the cap, according to another embodiment.
Figure 10:
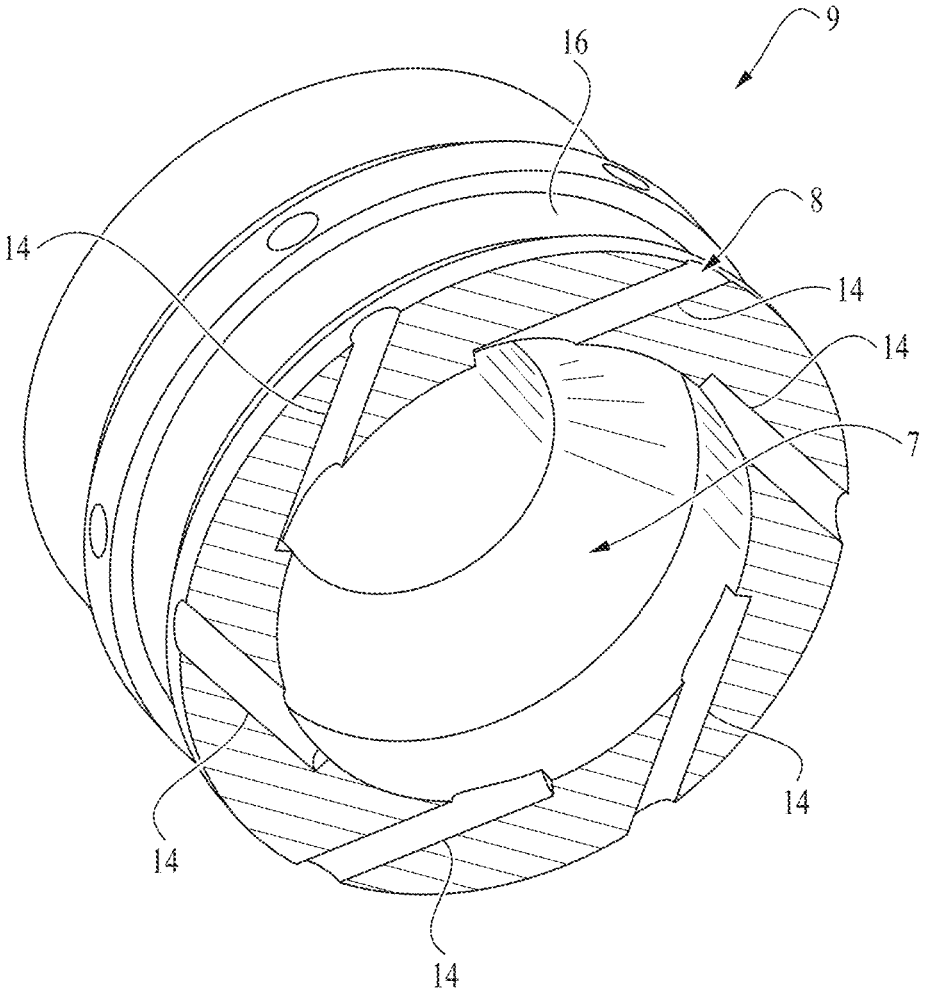
FIG. 10 is a perspective cross sectional view of the cap, according to yet another embodiment.

Referring to FIGS. 8-10, the openings 8 may include holes 14 extending through the cap 9. Referring to FIG. 8, the holes 14 may extend in a radial direction through the cap 9 (e.g., the holes 14 may not have axial nor circumferential components of direction). Referring to FIG. 9, the holes 14 may extend in a direction having a radial component and an axial component (e.g., the holes 14 may not have a circumferential component of direction). Referring to FIG. 10, the holes 14 may extend in a direction having a radial component and circumferential component (e.g., the holes 14 may not have an axial component of direction). Any number of holes 14 is within the scope of the present disclosure. In some embodiments a bore 17 is formed in the cap 9 for securing attachments. In other embodiments, instead of the bore, the cap 9 closed at the end to prevent material from entering at locations other than through the holes 14. The cap 9 may be pointed or rounded at the closed end.

Chamber 7 may be defined by an axial end 38 of the stop 5 and an interior surface 39 of the cap 9. The interior surface may include a first portion 41 having a first diameter D1 and a second portion 42 having a second diameter D2. There may be a chamfer 40 connecting the first portion 41 to the second portion 42. A third diameter D3 of the through hole 6 may be smaller than the second diameter D2. Advantageously, the larger diameter of the first portion 41 may allow particulates to settle there and potentially exit through the holes 14.

Figure 11:
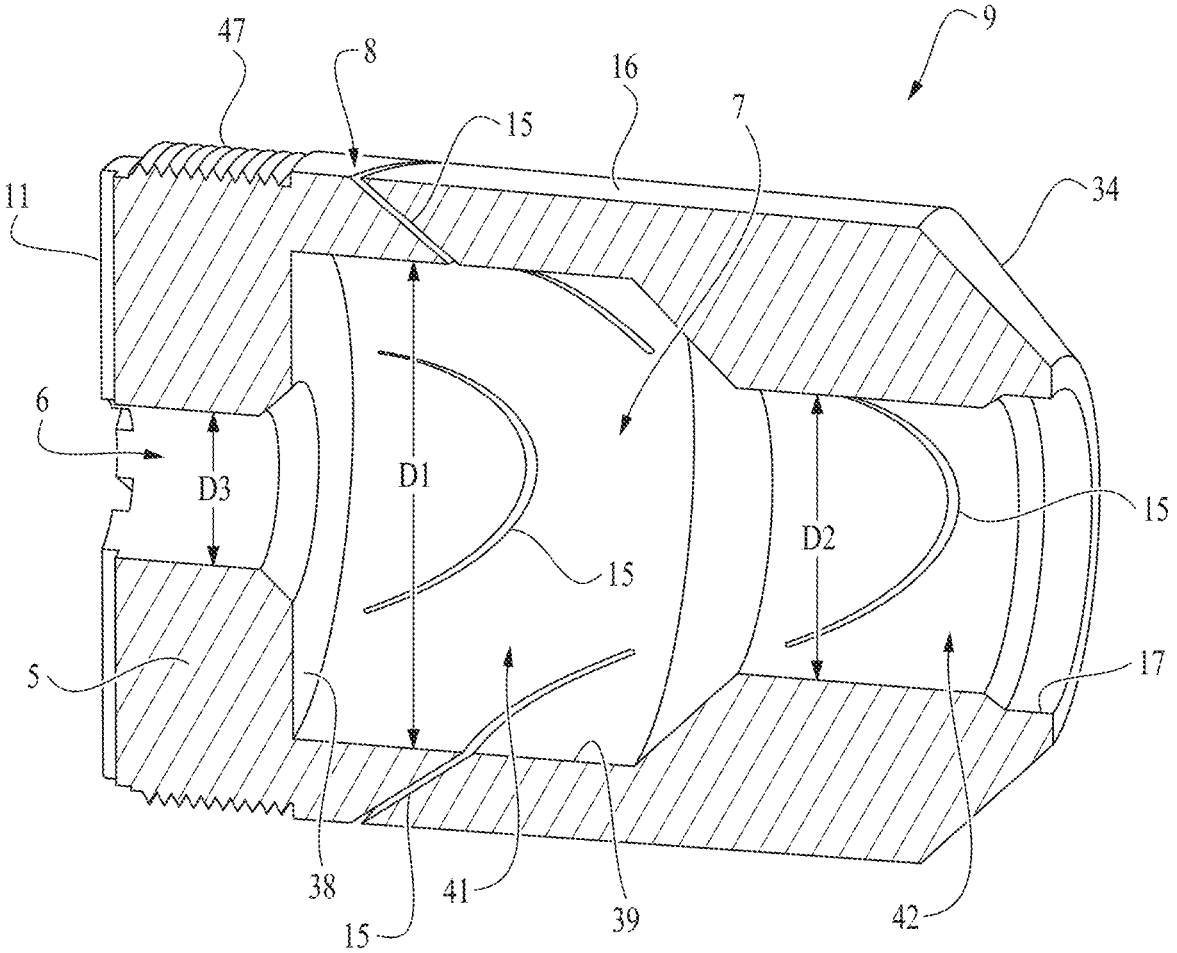
FIG. 11 is a perspective cross sectional view of the cap, according to yet another embodiment.

Referring to FIG. 11 the openings 8 may include slits 15 formed in an outer circumferential surface 16 of the cap 9. The slits 15 may be formed according to any suitable pattern. For example, the slits 15 may be U-shaped and overlap each other. In another example, the slits 15 may be curved and spaced apart from each other.

Figure 12:
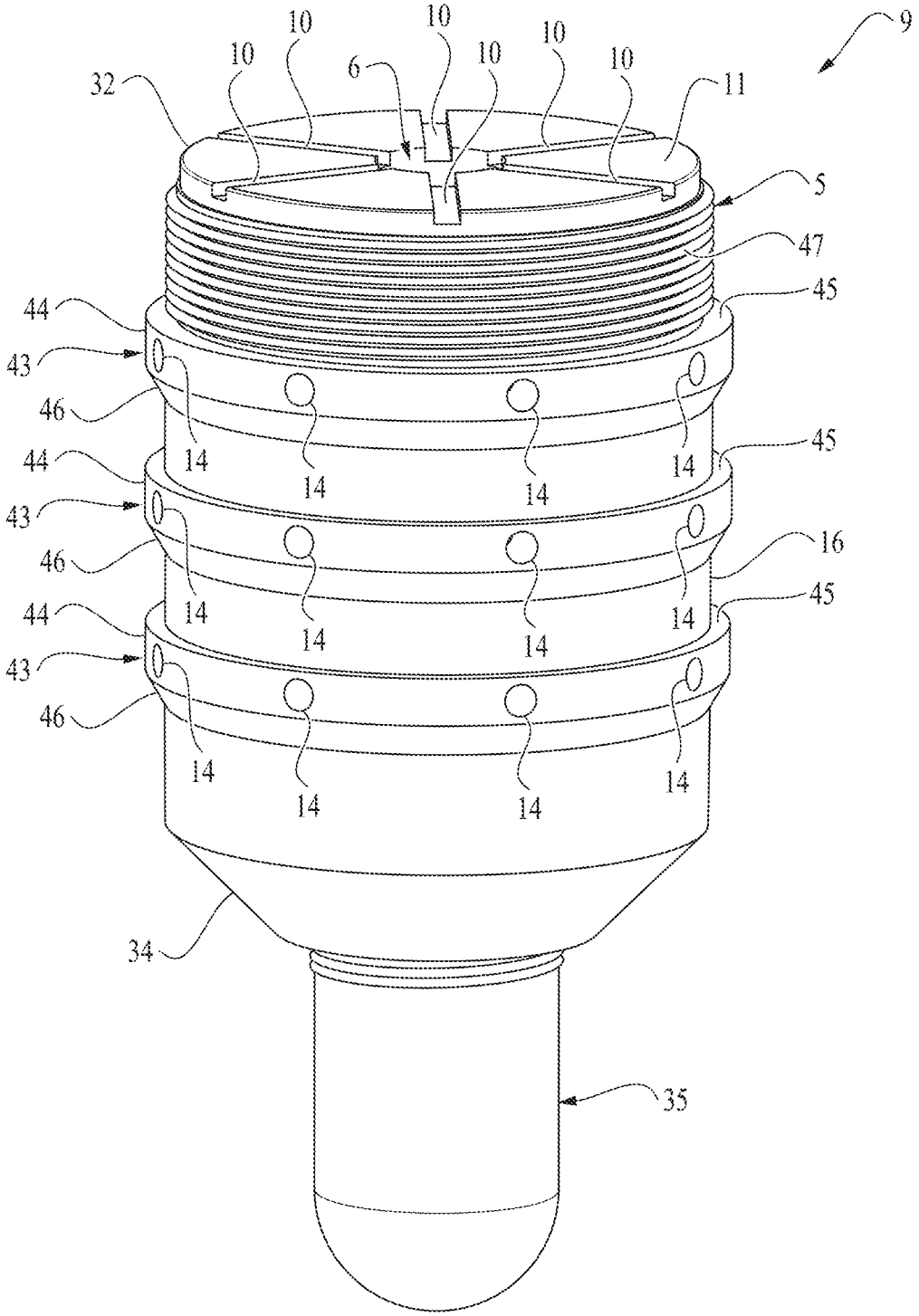
FIG. 12 is a perspective view of the embodiment of FIG. 6 with a bull plug attached.
Figure 13:
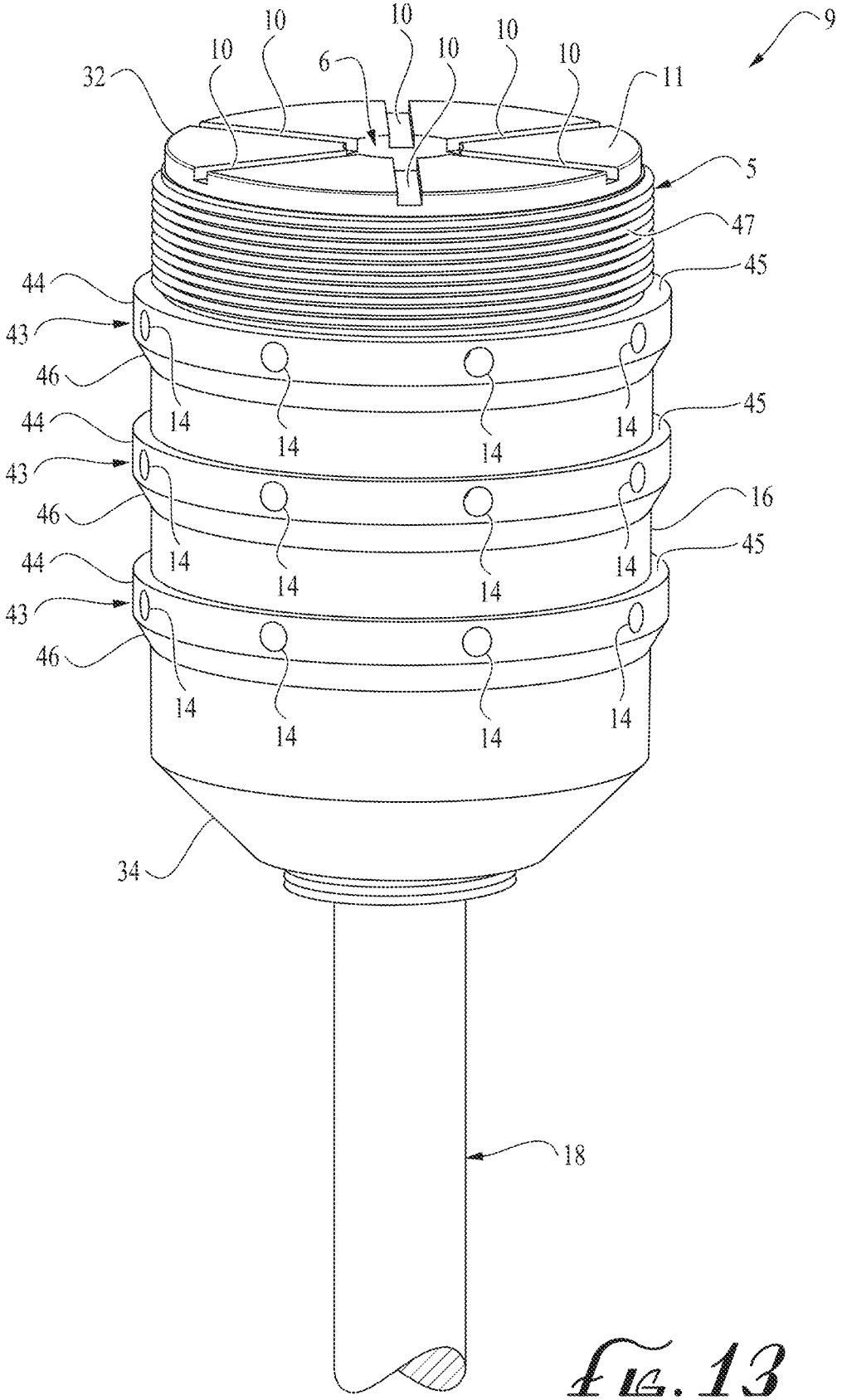
FIG. 13 is a perspective view of the embodiment of FIG. 6 with a tail pipe attached.

Referring to FIG. 12, the bellows system 150 may further include a bull plug 35 secured (e.g., screwed into) to a threaded bore 17 in an axial end of the cap 9. Advantageously, the bull plug 35 can be removed to inspect or otherwise confirm that the bellows is in contact with the stop 5 during assembly. In operation, the bull plug 35 may prevent particulates from entering the cap 9. Referring to FIG. 13, instead of the bull plug 35, the bellows system 150 may further include a tail pipe 18 screwed into the threaded bore 17 of the cap 9. There may be one or more ports in the tail pipe 18 for instrumentation and a bull plug may be attached at the end of the tail pipe 18. In some embodiments, an adapter tool ("A-tool") may be attached to the tail pipe 18.

Figure 14:
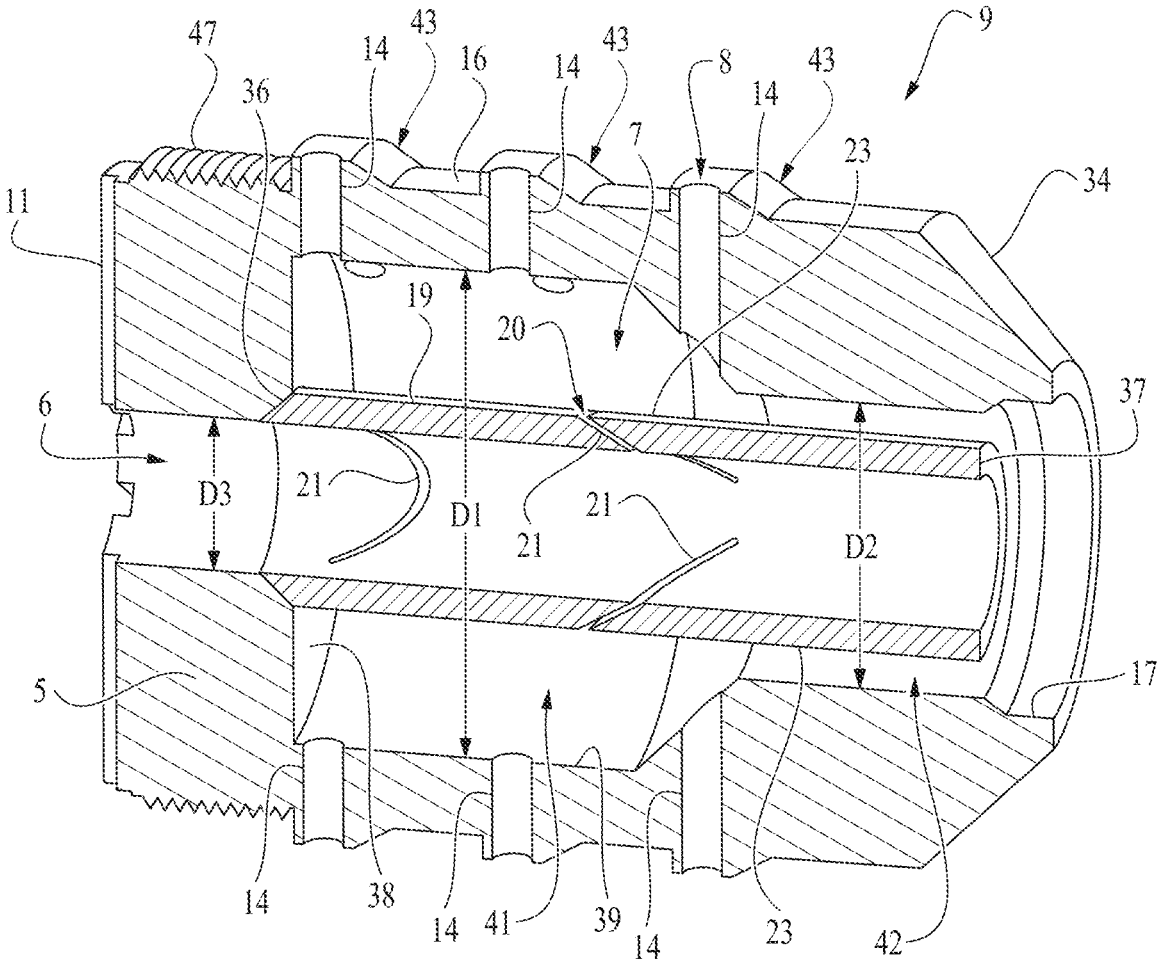
FIG. 14 is a perspective cross sectional view of the cap, according to yet another embodiment.
Figure 15:
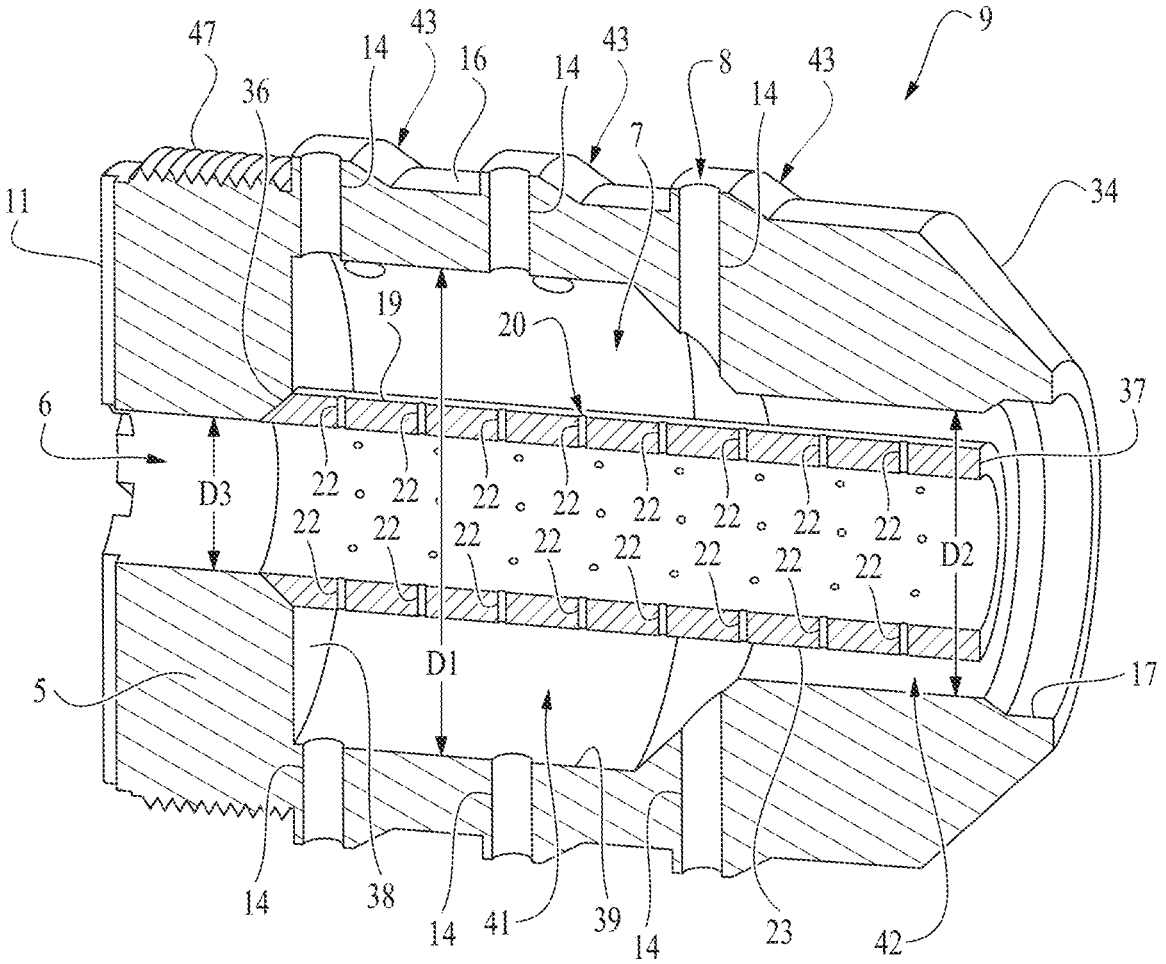
FIG. 15 is a perspective cross sectional view of the cap, according to yet another embodiment.
Figure 10:
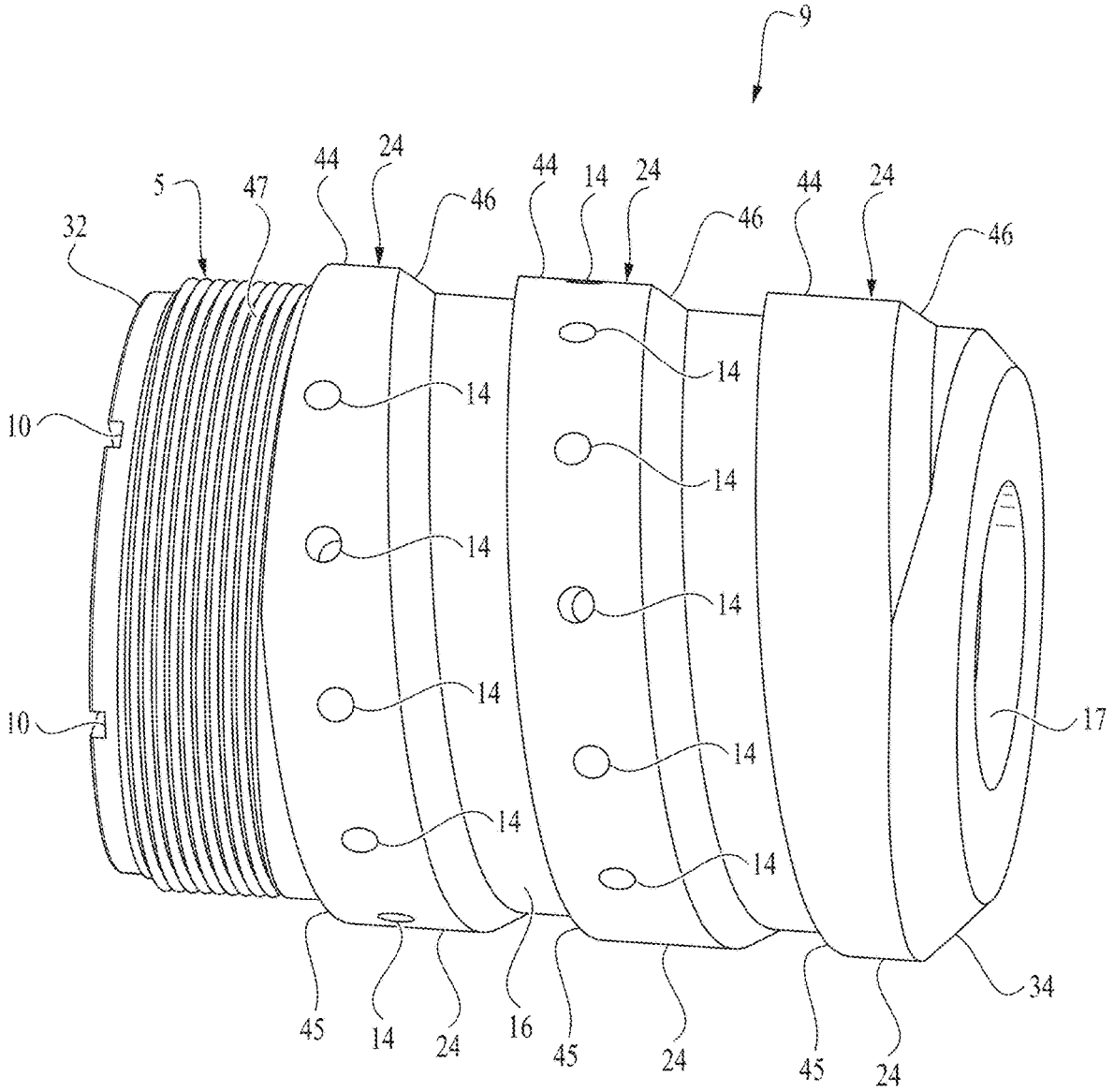

Referring to FIGS. 14-15, the bellows system 150 may further include a tube 19 extending from the stop 5 away from the bellows. The stop 5 may divide the volume inside the housing 1 from the volume inside the cap 9. The tube 19 may be concentric with the through hole 6 and/or may be in fluid communication with the through hole 6. For example, a diameter of the through hole 6 may be equal to an inner diameter of the tube 19. Second openings 20 may be formed in the tube 19. The second openings 20 may provide fluid communication between the chamber 7 and the interior of the tube 19. The tube 19 may be fastened to the stop 5 at a first end 36 of the tube 19 by any suitable means, for example, by threads (e.g., screwing the tube 19 into the stop 5), welding, or press fit. The tube 19 may be blocked at the second end 37 of the tube 19 (e.g., by a bull plug) such that particulates cannot enter from the second end 37 and can only enter through the second openings 20. Referring to FIG. 14, the second openings 20 may include slits 21 formed in an outer circumferential surface 23 of the tube 19. The slits 21 may be formed in any suitable pattern, for example, overlapping U-shaped slits or curved slits that are spaced apart. The outer circumferential surface 23 of the tube 19 may define the geometry of chamber 7. Referring to FIG. 15, the openings 20 may include holes 22 extending radially through the tube 19. There may be any suitable number of holes 22 disposed in any suitable pattern. The width or diameter of the second openings 20 may be less than the width or the diameter of the first openings 8.

Referring to FIG. 6, the holes 14 may be formed in raised ridges 43 formed on an outer circumferential surface 16 of the cap 9. The ridges 43 may be axially spaced apart along the cap 9. The holes 14 may be formed in a circumferential surface 44 of the ridges 43. The ridges 43 may further include an axial surface 45 connecting the circumferential surface 44 of the ridges 43 to the outer circumferential surface 16 of the stop 5. The ridges 43 may further include a chamfered surface 46 connecting the circumferential surface 44 of the ridges 43 to the outer circumferential surface of the stop 5. Advantageously, fluid may flow over the chamfered surface 46 and the circumferential surface 44 and form vortices or eddies in the space between the axial surface 45 of the ridge and the outer circumferential surface of the cap 9 (which may be a low-pressure zone). These vortices or eddies may entrain particulates and eventually allow them to fall away from the cap 9.

Referring to FIG. 16, the holes 14 may be formed in a helical ridge 24 that spirals around the outer circumferential surface 16 of the cap 9. Like the embodiment of FIG. 6, the helical ridge 24 may have the circumferential surface 44, the axial surface 45, and the chamfered surface 46, which may offer the same advantages in terms of fluid flow and particulate entrainment.

Figure 17:
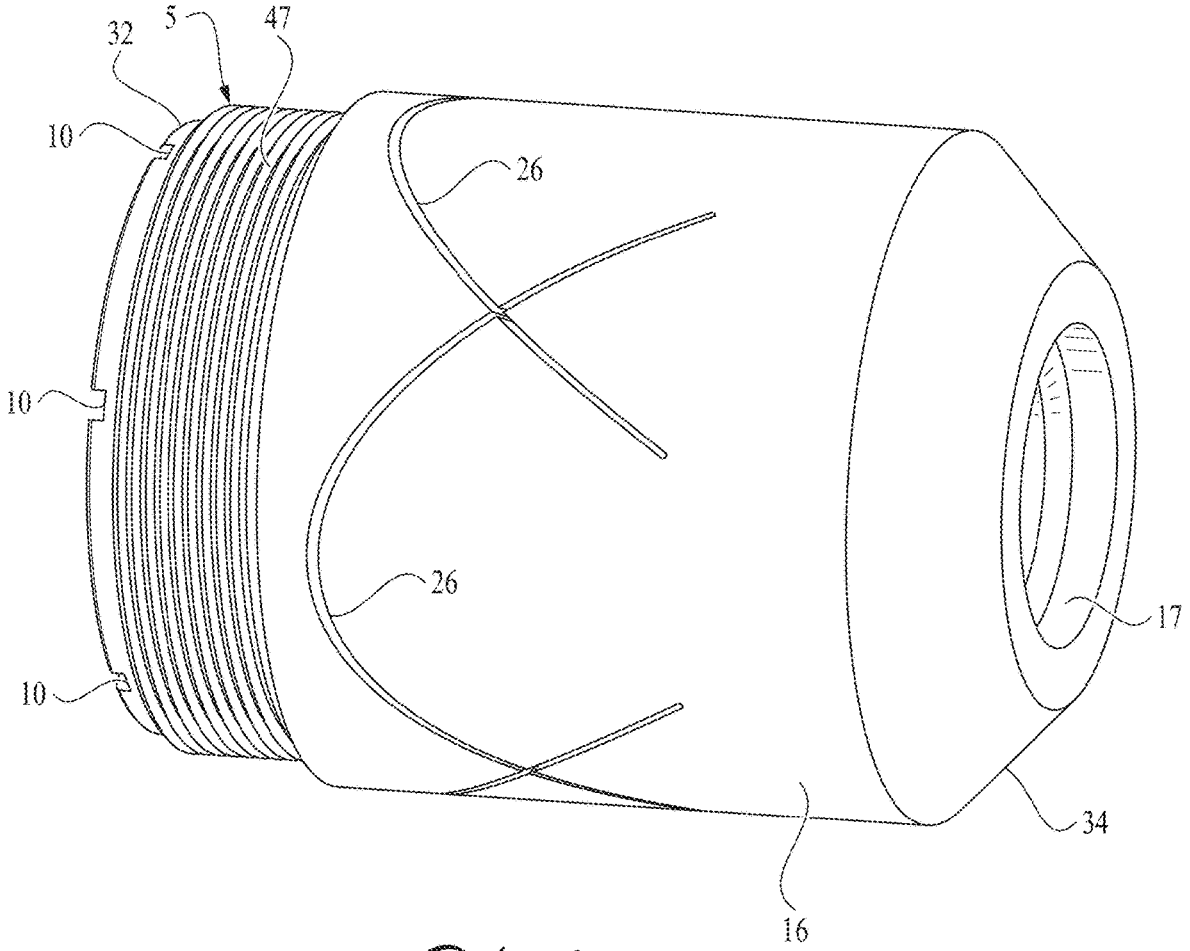
FIG. 17 is a perspective view of the cap with U-shaped slits, according to an embodiment.
Figure 18:
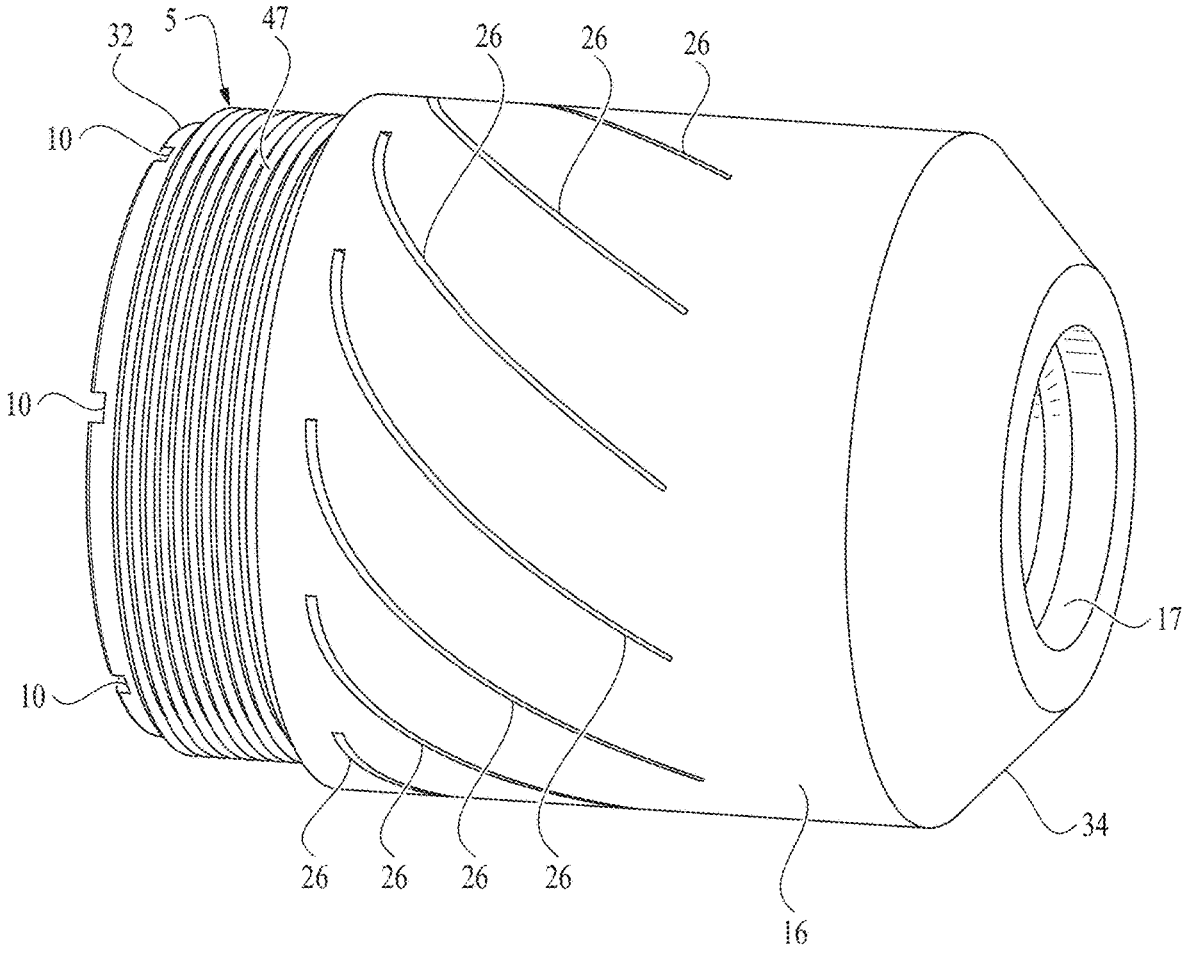
FIG. 18 is a perspective view of the cap with curved slits, according to an embodiment.

Referring to FIGS. 17-18, the openings 20 may include slits 26 formed in the outer circumferential surface 16 of the cap 9. Referring to FIG. 17, the slits 26 may be U-shaped and intersect one another. In this embodiment, at least a portion of the slit 26 may penetrate entirely through the material and at least a portion of the slit 26 may not penetrate entirely through the material to provide structural integrity for the part. Referring to FIG. 18, the slits 26 may be curved and be spaced apart from each other so as not to intersect. In this embodiment, the slits 26 may penetrate entirely through the material. Any geometry and pattern of the slits is within the scope of the present disclosure.

Figure 19:
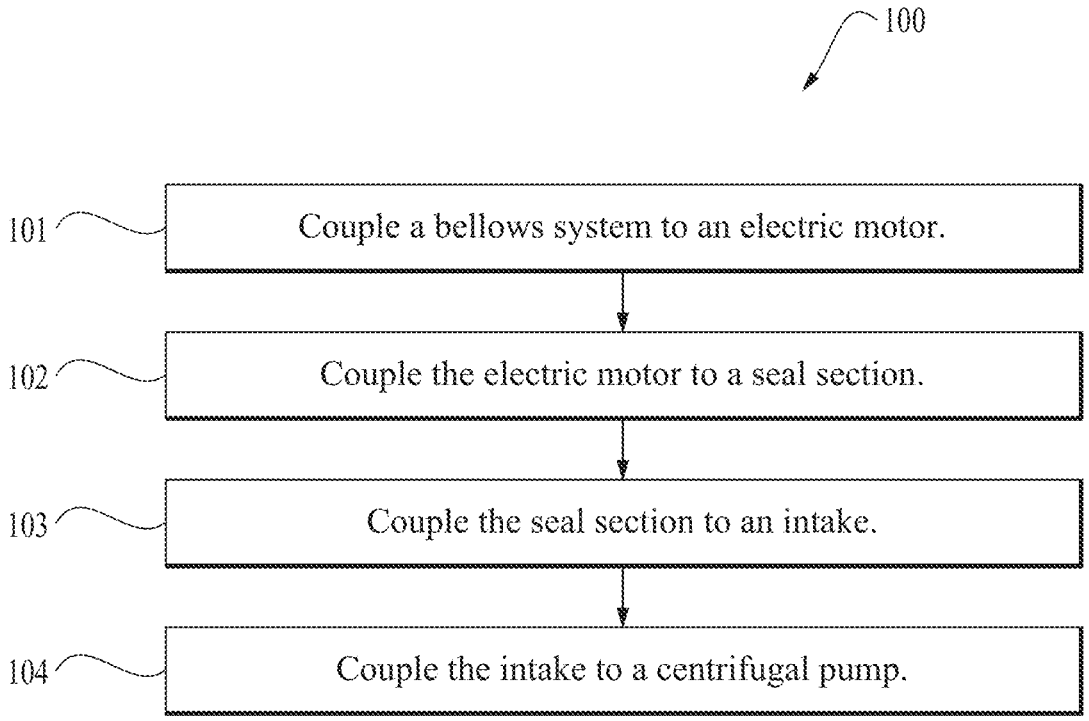
FIG. 19 is a method of assembling an electrical submersible pump, according to an embodiment.

Referring to FIG. 19, a method 100 of assembling an electric submersible pump may include the step 101 of coupling a bellows system to an electric motor; the step 102 of coupling the electric motor to a seal section; the step 103 of coupling the seal section to an intake; and the step 104 of coupling the intake to a centrifugal pump. The bellows system may include a housing; a bellows disposed within the housing, wherein the bellows comprises a first end secured (e.g., welded) to the housing and a second end configured to move within the housing; a stop having a through hole, wherein at a maximum extension of the bellows the second end abuts the stop; and a chamber disposed on an opposite side of the stop from the housing, wherein the chamber is in fluid communication with an exterior of the housing via first openings.

Figure 20:
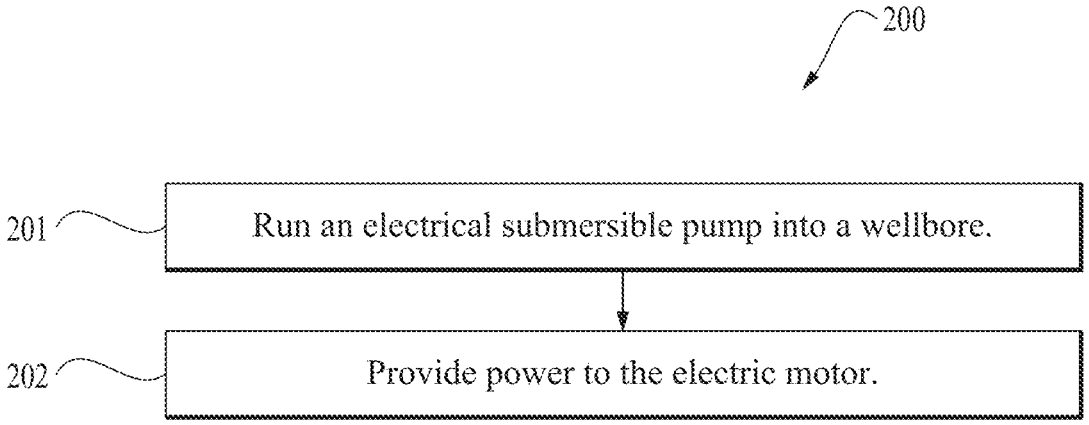
FIG. 20 is a method of lifting fluid in a wellbore, according to an embodiment.

Referring to FIG. 20, a method 200 of lifting fluid in a wellbore may include the step 201 of running an electrical submersible pump into a wellbore. The electrical submersible pump may include a bellows system, an electric motor coupled to the bellows system, a thrust chamber coupled to the motor, an intake coupled to the thrust chamber, and a centrifugal pump coupled to the intake. The method 200 may further include the step 202 of providing electric power to the electric motor, wherein the bellows system may include a housing; a bellows disposed within the housing, wherein the bellows comprises a first end secured to the housing and a second end configured to move within the housing; a stop having a through hole, wherein at a maximum extension of the bellows the second end abuts the stop; and a chamber disposed on an opposite side of the stop from the housing, wherein the chamber is in fluid communication with an exterior of the housing via first openings.

Due to the geometry of the cap, the system and method of the present disclosure may advantageously protect the bellows against sand and clogs, which may translate to longer system runtimes, increased reliability, and smoother operation of the electrical submersible pump.

ADDITIONAL DISCLOSURE

The following are non-limiting, specific embodiments in accordance with the present disclosure:

In a first embodiment, a bellows system for an electrical submersible pump comprises: a housing; a bellows disposed within the housing, wherein the bellows comprises a first end secured to the housing and a second end configured to move within the housing; a stop having a through hole, wherein at a maximum extension of the bellows the second end abuts the stop; and a chamber disposed on an opposite side of the stop from the housing, wherein the chamber is in fluid communication with an exterior of the housing via first openings.

A second embodiment can include the bellows system of the first embodiment, wherein the chamber is defined by the housing, and wherein the first openings are formed in the housing.

A third embodiment can include the bellows system of the first embodiment, wherein the chamber is defined by a cap which comprises the stop, wherein the first openings are formed in the cap, and wherein the cap is secured to the housing.

A fourth embodiment can include the bellow system of any of the first through third embodiments, wherein the chamber narrows moving away from the bellows.

A fifth embodiment can include the bellows system of any of the first through fourth embodiments, wherein grooves are formed in an axial surface of the stop, wherein the second end of the bellows is configured to abut the axial surface of the stop.

A sixth embodiment can include the bellows system of any of the first through fifth embodiments, wherein the stop comprises a platform and legs extending from the platform to an axial surface of the stop, wherein the second end of the bellows is configured to abut the platform.

A seventh embodiment can include the bellows system of any of the first through sixth embodiments, wherein the first openings comprise holes extending through the cap.

An eighth embodiment can include the bellows system of any of the first through seventh embodiments, wherein the holes extend in a radial direction through the cap.

A ninth embodiment can include the bellows system of any of the first through eighth embodiments, wherein the holes extend in a direction having a radial component and an axial component.

A tenth embodiment can include the bellows system of any of the first through ninth embodiments, wherein the holes extend in a direction having a radial component and circumferential component.

An eleventh embodiment can include the bellows system of any of the first through tenth embodiments, wherein the first openings comprise slits formed in an outer circumferential surface of the cap.

A twelfth embodiment can include the bellows system of any of the first through eleventh embodiments, further comprising a bull plug secured to a bore in an axial end of the cap.

A thirteenth embodiment can include the bellows system of any of the first through twelfth embodiments, further comprising a tail pipe screwed into a threaded hole in axial end of the cap.

A fourteenth embodiment can include the bellows system of any of the first through thirteenth embodiments, further comprising a tube extending from the stop away from the bellows, wherein the tube is concentric with the through hole, and wherein second openings are formed in the tube.

A fifteenth embodiment can include the bellows system of any of the first through fourteenth embodiments, wherein the second openings comprise holes extending radially through the tube.

A sixteenth embodiment can include the bellows system of any of the first through fifteenth embodiments, wherein the second openings comprise slits formed in an outer circumferential surface of the tube.

A seventeenth embodiment can include the bellows system of any of the first through sixteenth embodiments, wherein the holes are formed in raised ridges formed on an outer circumferential surface of the cap, wherein the ridges are axially spaced apart along the cap.

An eighteenth embodiment can include the bellows system of any of the first through seventeenth embodiments, wherein the holes are formed in a helical ridge that spirals around an outer circumferential surface of the cap.

In a nineteenth embodiment, a method of assembling an electrical submersible pump comprises: coupling a bellows system to an electric motor, coupling the electric motor to a seal section; coupling the seal section to an intake; and coupling the intake to a centrifugal pump, wherein the bellows system comprises: a housing; a bellows disposed within the housing, wherein the bellows comprises a first end secured to the housing and a second end configured to move within the housing; a stop having a through hole, wherein at a maximum extension of the bellows the second end abuts the stop; and a chamber disposed on an opposite side of the stop from the housing, wherein the chamber is in fluid communication with an exterior of the housing via first openings.

In a twentieth embodiment, a method of lifting fluid in a wellbore comprises: running an electrical submersible pump into a wellbore, wherein the electrical submersible pump comprises a bellows system, an electric motor coupled to the bellows system, a thrust chamber coupled to the electric motor, an intake coupled to the thrust chamber, and a centrifugal pump coupled to the intake; and providing electric power to the electric motor, wherein the bellows system comprises: a housing; a bellows disposed within the housing, wherein the bellows comprises a first end secured to the housing and a second end configured to move within the housing; a stop having a through hole, wherein at a maximum extension of the bellows the second end abuts the stop; and a chamber disposed on an opposite side of the stop from the housing, wherein the chamber is in fluid communication with an exterior of the housing via first openings.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations. For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. The use of terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. Any discussion of a reference herein is not an admission that it is prior art. Any disclosures of all patents, patent applications, and/or publications cited herein are hereby incorporated by reference, to the extent that they provide exemplary, procedural, or other details supplementary to those set forth herein.

As used herein, terms such as parallel, perpendicular, vertical, horizontal, and coincident are not intended to necessarily mean exactly parallel, exactly perpendicular, exactly vertical, exactly horizontal, and exactly coincident. Rather, those terms are intended to mean what those of ordinary skill in the art would recognize as parallel, perpendicular, vertical, horizontal, and coincident. In other words, those and similar terms may cover a structural configuration even when there is some imperfection, variation, or deviation from an exact relationship.

As used herein, the term "or" does not require selection of only one element. Thus, the phrase "A or B" is satisfied by either one or both elements from the set {A, B}. A clause that recites "A or B" can be infringed with only one of the listed items, both of the listed items, multiples of the listed items, and one or both of the listed items and another item not listed. The phrase "A, B, or C" is satisfied by any one or any combination of any two or more from the set {A, B, C}. A clause that recites "A, B, or C" can be infringed with only one of the listed items, multiples of the listed items, and one or more of the items from the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A bellows system for an electrical submersible pump, comprising:

a housing;

a bellows disposed within the housing, wherein the bellows comprises a first end secured to the housing and a second end configured to move within the housing;

a cap secured to the housing, wherein the cap comprises a stop having a through hole, wherein at a maximum extension of the bellows the second end abuts the stop, and wherein first openings are formed in the cap;

a tube extending from the stop away from the bellows, wherein the tube is concentric with the through hole, and wherein second openings are formed in the tube; and a chamber disposed on an opposite side of the stop from the housing, wherein the chamber is defined by the cap, and wherein the chamber is in fluid communication with an exterior of the housing via the first openings.

2. The bellows system of claim 1, wherein the chamber is further defined by the housing.

3. The bellows system of claim 1, wherein the chamber narrows moving away from the bellows.

4. The bellows system of claim 1, wherein grooves are formed in an axial surface of the stop.

5. The bellows system of claim 1, wherein the stop comprises a platform and legs extending from the platform to an axial surface of the stop.

6. The bellows system of claim 1, wherein the first openings comprise holes extending through the cap.

7. The bellows system of claim 6, wherein the holes extend in a radial direction through the cap.

8. The bellows system of claim 6, wherein the holes extend in a direction having a radial component and an axial component.

9. The bellows system of claim 6, wherein the holes extend in a direction having a radial component and a circumferential component.

10. The bellows system of claim 6, wherein the first openings comprise slits formed in an outer circumferential surface of the cap.

11. The bellows system of claim 1, further comprising a bull plug secured to a bore in an axial end of the cap.

12. The bellows system of claim 1, further comprising a tail pipe screwed into a threaded hole in an axial end of the cap.

13. The bellows system of claim 1, wherein the second openings comprise holes extending radially through the tube.

14. The bellows system of claim 1, wherein the second openings comprise slits formed in an outer circumferential surface of the tube.

15. The bellows system of claim 6, wherein the holes are formed in raised ridges formed on an outer circumferential surface of the cap, wherein the ridges are axially spaced apart along the cap.

16. The bellows system of claim 6, wherein the holes are formed in a helical ridge that spirals around an outer circumferential surface of the cap.

17. The bellows system of claim 4, wherein the second end of the bellows is configured to abut the axial surface of the stop.

18. The bellows system of claim 5, wherein the second end of the bellows is configured to abut the platform.

19. A method of assembling an electrical submersible pump, comprising:

coupling a bellows system to an electric motor;

coupling the electric motor to a seal section;

coupling the seal section to an intake; and coupling the intake to a centrifugal pump, wherein the bellows system comprises:

a housing;

a bellows disposed within the housing, wherein the bellows comprises a first end secured to the housing and a second end configured to move within the housing;

a cap secured to the housing, wherein the cap comprises a stop having a through hole, wherein at a maximum extension of the bellows the second end abuts the stop, and wherein first openings are formed in the cap;

a tube extending from the stop away from the bellows, wherein the tube is concentric with the through hole, and wherein second openings are formed in the tube; and a chamber disposed on an opposite side of the stop from the housing, wherein the chamber is defined by the cap, and wherein the chamber is in fluid communication with an exterior of the housing via the first openings.

20. A method of lifting fluid in a wellbore, comprising:

running an electrical submersible pump into a wellbore, wherein the electrical submersible pump comprises a bellows system, an electric motor coupled to the bellows system, a seal section coupled to the electric motor, an intake coupled to the seal section, and a centrifugal pump coupled to the intake; and providing electric power to the electric motor, wherein the bellows system comprises:

a housing;

a bellows disposed within the housing, wherein the bellows comprises a first end secured to the housing and a second end configured to move within the housing;

a cap secured to the housing, wherein the cap comprises a stop having a through hole, wherein at a maximum extension of the bellows the second end abuts the stop, and wherein first openings are formed in the cap;

a tube extending from the stop away from the bellows, wherein the tube is concentric with the through hole, and wherein second openings are formed in the tube; and a chamber disposed on an opposite side of the stop from the housing, wherein the chamber is defined by the cap, and wherein the chamber is in fluid communication with an exterior of the housing via the first openings.

* * * * *